United States Patent [19]

Tervamäki

[11] Patent Number: 4,953,575

[45] Date of Patent: Sep. 4, 1990

[54] WASHING DEVICE

[75] Inventor: Jukka Tervamäki, Helsinki, Finland

[73] Assignee: Labsystems Oy, Helsinki, Finland

[21] Appl. No.: 415,636

[22] Filed: Oct. 2, 1989

[30] Foreign Application Priority Data

Sep. 30, 1988 [FI] Finland ..... 884502

[51] Int. Cl.[5] ..... B08B 3/02

[52] U.S. Cl. ..... 134/57 R; 134/113; 134/144; 134/152; 134/153; 134/159; 494/18

[58] Field of Search ..... 134/144, 152, 153, 159, 134/57 R, 113; 494/17, 18, 34; 141/89; 34/58; 422/72

[56] References Cited

U.S. PATENT DOCUMENTS

| | | | |
|---|---|---|---|
| 3,706,413 | 12/1972 | Blum | 494/17 X |
| 4,315,593 | 2/1982 | Matte | 494/17 X |
| 4,779,634 | 10/1988 | Gutierrez et al. | 141/89 X |

FOREIGN PATENT DOCUMENTS

| | | | |
|---|---|---|---|
| 0027986 | 5/1981 | European Pat. Off. . | |
| 0205106 | 12/1986 | European Pat. Off. | 494/16 |
| 232321 | 3/1911 | Fed. Rep. of Germany | 134/153 |
| 62-110156 | 5/1987 | Japan . | |

*Primary Examiner*—Philip R. Coe

*Attorney, Agent, or Firm*—Hopgood, Calimafde,Kalil, Blaustein & Judlowe

[57] ABSTRACT

The invention relates to a washing device for cuvette sets. The cuvette set is placed into a holder (11) in a rotor (10). The washing liquid is removed from the cuvettes by rotating the rotor.

10 Claims, 2 Drawing Sheets

WASHING DEVICE

The present invention concerns a washing device and a washing method for cuvette sets. The invention is suitable for use in particular for washing of cuvette sets used in immunological assays, such as so-called microdisks.

In assay methods of certain types, the signal given by the substance immobilized on the inner wall of a cuvette is measured. Such methods include in particular many immunological assay methods. In most cases these methods involve washing steps, wherein a solution is removed out of the cuvette set. The washing steps are frequently still carried out manually, but various manually operated or automatic apparatuses are also known.

In the prior-art cuvette-set washing devices, the washing liquid is most commonly introduced into, and removed from, the cuvette to be washed by means of thin tubes. This principle is employed, e.g., in the automatic EIA equipment described in the publication WO 87/02138. When liquid is being removed, the suction tube must be lowered as close to the cuvette bottom as possible in order that all the washing liquid could be removed. Thereat there is a risk that the tip of the tube scratches the bottom, whereby part of the substance to be detected may be detached from the bottom, and at the same time a scratch may be produced which changes the optical properties of the bottom. Both of these circumstances may cause an error of measurement in particular when a photometer that measures through the bottom is used.

The main object of the present invention is to eliminate the drawbacks mentioned above.

The objectives of the invention are achieved by the means stated in the patent claims.

In accordance with the invention the cuvettes are placed into a holder on a rotor, and liquid is removed out of the cuvettes by means of centrifugal force. The shaft of the rotor is preferably horizontal. The rotor is preferably placed inside a protective chamber.

Figure 1:
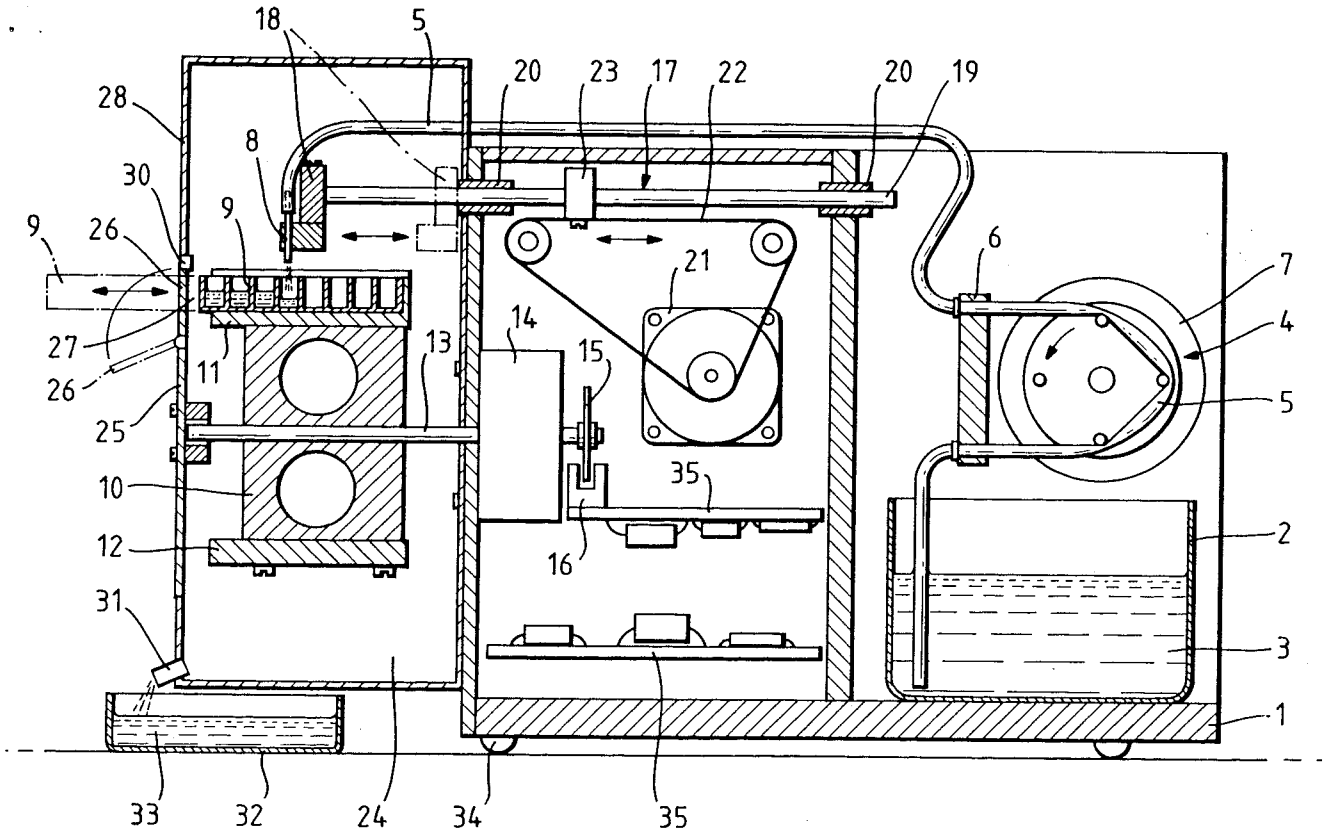
Figure 2:
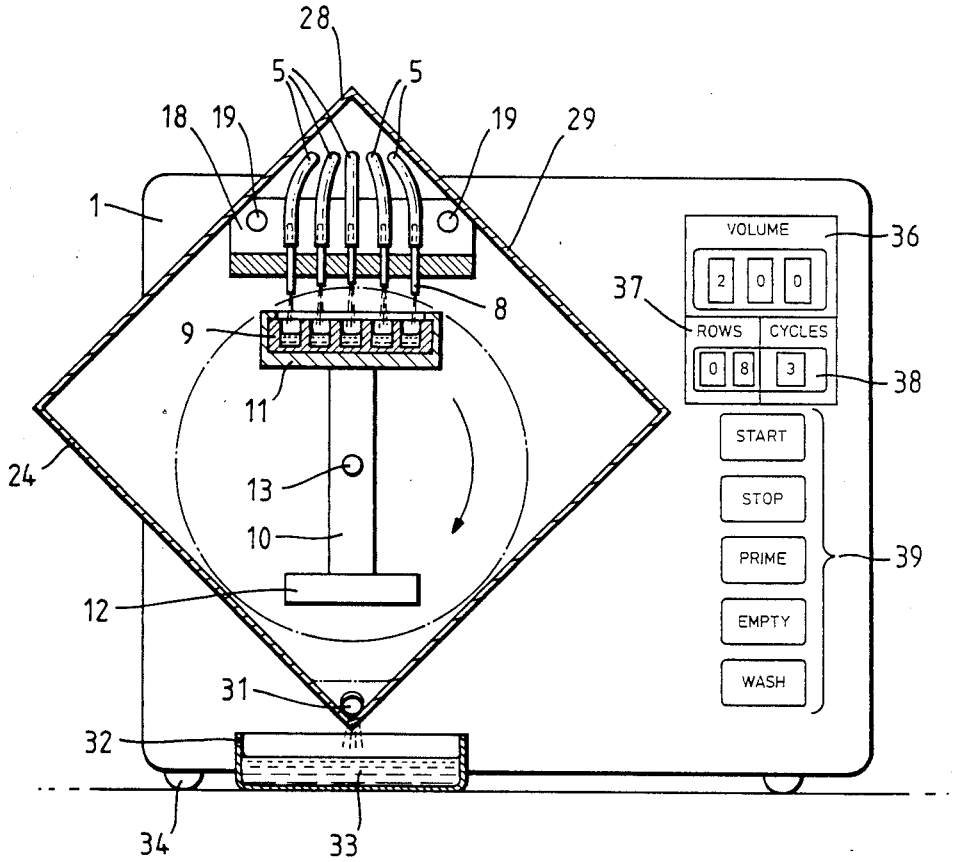

In the accompanying drawings, which are a part of the specification of the invention, FIG. 1 is a side view of a washing device in accordance with the invention, and FIG. 2 is a front view of a corresponding device.

The device in accordance with FIGS. 1 and 2 comprises a frame 1, on which the parts of the device are fitted. The vessel 2 contains washing liquid 3. It can be pumped out of the vessel by means of a tubing pump 4 through the hoses 5. The hoses are tensioned by means of a holder 6, which is preferably adjustable. The tubing pump is rotated by means of a stepping motor 7. The washing liquid is pumped along the hoses into the dosage tips 8.

The cuvette set 9 to be washed is placed in a holder 11 placed on the periphery of a rotor 10, into which it can be pushed from the front and locked in its position. The weight of the cuvette set and its holder is counterbalanced by a counterweight 12 placed at the opposite side of the rotor.

The rotor 10 is rotated, by the intermediate of a shaft 13, by a motor 14, which may be a stepping motor, a servomotor, or a DC-motor.

In order that the rotor 10 could be positioned exactly in the desired position for dosage of washing liquid 3 into the cuvettes of the cuvette set 9 placed in the holder 11, a disk 15 is mounted on an extension of the shaft 13. The disk is provided with a groove code, which can be read by means of an opto-electric reading fork 16.

In stead of a disk 15 and a reading fork 16, it is, of course, possible to use other positioning devices, such as a magnet and a Hall element or an encoder. For stopping the rotor, e.g., a brake shoe may be used, which is pressed against the disk 15.

The cuvette set 9 is a matrix consisting of horizontal and vertical rows. The dosage tips 8 measure washing liquid into one vertical row at a time and move thereupon onto the next vertical row.

The dosage-tip transfer device 17 comprises transfer rods 19 attached to the dosage-tip fastening piece 18, which said rods 19 move inside guide bushings 20 fixed to the frame. The rods are displaced by a stepping motor 21 by the intermediate of a cogged belt 22 and a fastening piece 23.

The stepping motor 21 and the belt may, of course, be substituted for, e.g., by a servomotor and a cogwheel and a toothed rack.

The rotor 10 is enclosed in a protective chamber 24. The front side of the chamber is closed by a front cover 25. The cuvette set 9 is placed into its position in the holder through an opening 27 closed by means of a door 26 provided in the front cover. The chamber 24 comprises a sharp top corner 28 in order to avoid dropping of liquid and to facilitate its running downwards along the side walls of the chamber.

The tip-fastening piece 18 is during centrifugation placed outside the periphery of the rotor 10 on the rear wall of the chamber 24, so that liquid drops will not fly up to the fastening piece.

The door 26 of the opening 27 at the front side is further provided with a protective mechanism 30, such as, e.g., a microswitch, by means of which starting of the device is prevented when the cover is open.

A pipe 31 is connected to the lowest point of the protective chamber 24, through which said pipe the spent washing liquid flows out of the chamber into a vessel 32. If necessary, the vessel may contain, e.g., a viricidal and bactericidal inactivation solution 33. Of course, the pipe may also be connected to a hose along which the substances can drain into a closed bottle.

Underneath the frame there are soft rubber cushions 34 to prevent transfer of vibration, which may be caused by possible slight lack of balance, to the base.

The operation of the device and the three stepping motors are controlled by means of electronic cards 35, the necessary movements and the washing process having been programmed in the microprocessor contained in said cards. The operator may select the operations from function selectors, whereof the selector 36 sets the quantity of washing liquid to be measured per cuvette, the selector 37 selects the number rows to be measured into (measuring is not always performed to all the rows), and the selector 38 the number of washing cycles. By means of the keys 39 the starting of the device, the stopping of the device, the initial filling and final emptying of the hoses, as well as possible other separate functions or parts of the basic process are performed.

The mode of operation and the functions of the device are as follows:

First the operator fills the vessel 2 with washing liquid 3. Hereupon the knob PRIME 39 is pressed, whereby the pump 7 revolves and the hoses 5 are filled with liquid. By that time the rotor 10 and the liquid-dosage tips 8 have been run by the motors 21 and 14 to such positions that washing liquid does not fall onto the cuvette-set 9 holder 11. After the hoses 5 have been filled, the operator opens the front cover 26 and pushes the cuvette set into the holder, and closes the front cover thereupon.

After these operations, the operator just has to press the knob START to start the device, whereat the rotor first revolves a few revolutions and removes any liquids from an earlier process step that may have been present in the cuvette set. Hereupon, by means of the disk 15 and the reading fork 16, the motor 14 stops the rotor 10 and the cuvette set 9 exactly in the dosage position, and the motor 21 runs the dosage tips to above the first row in the cuvette set. Thereupon the motor 7 revolves to the necessary extent and fills the first row in the cuvette set with washing liquid. In this way the motors 21 and 7 alternate until the whole cuvette has been filled. Hereupon the motor 21 runs the dosage tips from above the cuvette set for the time of the centrifuging, and the motor 14 starts the emptying of the cuvette set. In this way alternating filling and emptying phases are continued until the desired number of washing cycles have been performed. The selections have been made in advance by means of the selection switches 36, 37 and 38. The operator may now open the front cover 26 and remove the washed cuvette set out of the device.

In one embodiment, in stead of a counterbalance weight, a second holder and cuvette set are used on the rotor. Of course, if desired, it is possible to place a higher number of cuvette sets on the rotor.

The holder of a cuvette set may be made detachable, in which case it can be replaced so as to be always suitable for the particular cuvette set that is being used in each particular case.

What is claimed is:

1. A washing device for washing cuvette sets comprising:

a frame (1)

a tube pump (4) supported within said frame having cooperatively associated therewith a vessel (2) for containing washing liquid (3) therein, at least one hose (5) cooperatively associated with said tube pump, said hose (5) communicating with said vessel (2) and extending through said tube pump and to a cuvette holding means located downstream of said tube pump (4) whereby said tube pump (4) causes washing liquid (3) to flow from said vessel (2), through said pump and to said cuvette holding means via a dosage transfer device (17) to which an end of said hose (5) is connected, a compartment located downstream of said tube pump (4) with said dosage transfer device (17) slidably mounted therein, a stepping motor (21) mounted within said compartment and drivingly coupled to said dosage transfer device, said dosage transfer device (17) being mounted to move backward and forward via said stepping motor, a chamber (24) fixed to a joining wall of said compartment into which said dosage transfer device (17) extends, a rotor assembly (10) mounted on a shaft (13) rotatably supported in said chamber, said shaft extending into said compartment and coupled to a motor (14) mounted in said compartment, and said cuvette holding means (11) disposed on a surface of said rotor assembly (10) for detachably mounting a cuvette set thereto to be washed, said dosage transfer device having means at its end for supporting at least one hose (5) extending into said chamber (24) from said tube pump, whereby cuvette sets are washed by feeding washing liquid (3) via said tube pump (4) to said at least one hose (5) connected at its end to said transfer device (17) by depositing washing fluid (3) into said cuvettes and the washing fluid thereafter removed by centrifugal force by rotating said rotor confined in said chamber (24).

2. The washing device of claim 1, wherein said rotatable shaft (13) is substantially horizontally supported in said chamber (24).

3. The washing device of claim 2, wherein the chamber (24) has a rectangular configuration, and wherein said chamber is supported with a pair of opposite corners (28) thereof substantially vertically disposed.

4. The washing device of claim 3, wherein said chamber (24) is provided with drain means (31) through which wash liquid (3) is removed following washing.

5. The washing device of claim 1, wherein the end of said hose (5) is provided with a dosage tip (8) which is disposed and supported above said cuvette holding means.

6. The washing device of claim 5, wherein a plurality of hoses (5) are employed and arranged to a plurality of cuvettes disposed in horizontal rows on said cuvette holding means (11).

7. The washing device of claim 1, wherein said chamber (24) is provided with an opening (27) and a door (26) through which cuvette sets are charged to and removed from said cuvette holding means (11).

8. The washing device of claim 7, wherein the opening and door (26,27) is provided with a safety device that operates to prevent starting of the washing device when the door is open.

9. The washing device of claim 1, wherein said rotatable shaft (13) coupled to and extending through said motor (14) is provided at its end with cooperatively associated sensing means (15,16) by means of which the rotor (10) can be stopped in a desired position.

10. The washing device of claim 9, wherein said sensing means (15,16) is cooperatively associated with programmed electronic cards (35) associated with said washing device.

* * * * *